US005681452A

United States Patent [19]

Kirkbride

[11] Patent Number: 5,681,452

[45] Date of Patent: Oct. 28, 1997

[54] PROCESS AND APPARATUS FOR CONVERTING OIL SHALE OR TAR SANDS TO OIL

[76] Inventor: Chalmer G. Kirkbride, 4000 Massachusetts Ave. NW., Suite 805, Washington, D.C. 20016

[21] Appl. No.: 551,019

[22] Filed: Oct. 31, 1995

[51] Int. Cl.[6] ..... C10G 1/04

[52] U.S. Cl. ..... 208/390; 208/412; 208/418

[58] Field of Search ..... 208/390, 412, 208/418

[56] References Cited

U.S. PATENT DOCUMENTS

| | | | |
|---|---|---|---|
| 3,855,070 | 12/1974 | Squires | 201/23 |
| 4,017,585 | 4/1977 | Angevine | 423/167 |
| 4,032,305 | 6/1977 | Squires | 48/73 |
| 4,111,158 | 9/1978 | Reh et al. | 122/4 D |
| 4,123,230 | 10/1978 | Kirkbride | 44/112 |
| 4,144,189 | 3/1979 | Kirkbride | 44/112 |
| 4,148,614 | 4/1979 | Kirkbride | 44/112 |
| 4,153,533 | 5/1979 | Kirkbride | 44/112 |
| 4,234,402 | 11/1980 | Kirkbride | 44/112 |
| 4,279,722 | 7/1981 | Kirkbride | 44/112 |
| 4,412,914 | 11/1983 | Hettinger, Jr. | 208/253 |
| 4,601,657 | 7/1986 | Hein et al. | 110/347 |
| 4,818,373 | 4/1989 | Bartholic et al. | 208/252 |
| 4,842,719 | 6/1989 | MacArthur et al. | 208/404 |
| 5,147,511 | 9/1992 | Woebcke | 422/196 |
| 5,531,884 | 7/1996 | Johnson et al. | 422/196 |

*Primary Examiner*—Helane Myers

[57] ABSTRACT

The invention relates to a continuous process for producing synthetic crude oil from oil bearing material, e.g., oil shale or tar sand, through continuous loading, calcining and unloading operations in three triangularly placed reactor tubes that are loaded with oil bearing material from a common feed source.

13 Claims, 5 Drawing Sheets

PROCESS AND APPARATUS FOR CONVERTING OIL SHALE OR TAR SANDS TO OIL

FIELD OF THE INVENTION

The present invention relates to a continuous process for producing synthetic crude oil from oil shale or tar sands and an apparatus for its practice. More specifically, the present invention uses three vertical reaction tubes that are arranged parallel to one another and are continuously loaded with shale or bitten and are operated in sequential and continuous predetermined time periods to render the process continuous. The invention also relates to soil and construction compositions based on the spent shale or tars sands and their use.

BACKGROUND OF THE INVENTION

The processing of oil shale and bitumen (tar sands) to produce commercially viable products has long been desired. However, existing shale or bitumen technology for recovering viable petroleum products contained therein is not economically feasible. In addition, spent shale or tar sand is a waste material that has not been constructively used.

An exemplary process for recovering oil from oil shale involves retorting oil shale so that the kerogen molecules are cracked. Inorganic matter of the shale must be separated from the heavy, highly unsaturated, highly viscous components. These fluidic components must be further processed by cracking, hydrocracking, hydrogenating, or by other processes.

FIG. 1 shows a known fixed bed process for treating oil shale. The temperature conditions and flow rates of the materials described are only provided for illustration and are not intended to be limited to those values. According to the process of FIG. 1, oil shale from a mine 10 (180,000 tons/day or 7,500 tons/hour) is conveyed via a bucket elevator 12 to a feed hopper 14. Raw shale in feed hopper 14 is maintained at about 60° F. and is charged through feed valve 16 into a pressure equalizer 18. The shale is then conveyed through valve 20 into reactor 22 where hydrogen at 600 psi is introduced into reactor 22 at several locations.

Reactor 22 may be of any conventional design and, in particular, has a diameter of about 12 feet and a height of about 100 feet. Hydrogen is conveyed through line 26 and controllably introduced into reactor 22 via control valves 24. The hydrogen in line 26 comprises recycle and make-up hydrogen at a temperature of approximately 910° F. The shale is processed in the reactor to produce synthetic crude, bi-products, hydrogen for recycling and spent shale.

Shale is discharged from reactor 22 through line 28 at a temperature of about 900° F. and at a rate of about 6,750 tons/hour. Synthetic crude, bi-products and recycle hydrogen at 850° F. are discharged from reactor 22 through flow line 30. The products in flow line 30 are conveyed to and introduced into heat exchanger bank 32 concurrently with make-up hydrogen plus recycle via flow line 72, whereby heat is transferred from the process products in line 30 to the hydrogen from line 72.

Cooled products from exchanger 32 are conveyed to cooler 36 and are thereafter introduced into a condensate drum 42. The bottoms from the condensate drum 42 include synthetic crude and bi-products that are removed and sent to a syncrude stripper 48 concurrently with a stripping hydrogen stream in line 70 from hydrogen source 66. The products from stripper 48, e.g., syncrude, are removed via line 49 at 180,000 barrels/day. A top product from stripper 48 is conveyed via line 50 to a bi-products recovery plant 52.

In bi-products recovery plant 52, elemental sulfur is produced and removed through line 58. Anhydrous ammonia ($NH_3$) is also produced and removed via line 60. A hydrogen stripping stream is produced in plant 52 and is removed via line 62 and thereafter introduced into line 72 for recycling and use in exchange bank 32. Hydrogen that is produced in plant 52 is removed through line 54 and thereafter introduced into line 72. In addition, all the product streams from plant 52 are processed in a manner known to those skilled in the art to remove sulfur compounds to obtain useable products. The disadvantage of the process described by FIG. 1 is that it is not a continuous process.

In another known process for converting kerogen of oil shale to oil petroleum products, U.S. Pat. No. 4,153,533, a mixture of oil shale and hydrogen is subjected to wave energy in the microwave range to obtain oil.

In these and other oil shale and tar sands processes, the feed material must be mined. As a result, the sites that are mined/excavated to produce the feed for these processes are left untreated, resulting in depleted and non-usable land.

Thus, a need exists to provide a continuous process for treating oil shale and/or tar sands that is economical. A need also exists for practical use of spent product wastes that are generated from these processes. The present invention eliminates the drawbacks and limitations of batch or fixed bed type oil shale or tar sand conversion processes, as well as, the problems encountered when dealing with waste materials from these processes.

BRIEF SUMMARY OF THE INVENTION

The present invention relates to a continuous process for converting oil bearing material, e.g., oil shale or tar sands and an apparatus for its practice. The oil bearing material is continuously introduced into first, second and third discrete vertical reaction zones that are parallel to one another and form a triangular configuration. The three reaction zones are operated during contiguous and sequentially arranged time periods to provide a continuous process.

Accordingly, one aspect of the present invention is to provide a continuous process and an apparatus for its practice where oil bearing material such as oil shale or bitumen (tar sands) is continuously treated.

Another object of the present invention is to reclaim mined or excavated land that results from mining oil shale or bitumen.

A still further object of the present invention is the preparation of an agriculturally acceptable soil replacement from spent oil bearing material, garbage and cellulosic waste.

A further object of the present invention is the preparation of construction materials, e.g. cement, gypsum based upon spent oil bearing material.

These and other objects will become more apparent in view of the following detailed description and annexed drawings.

Figure 2C:
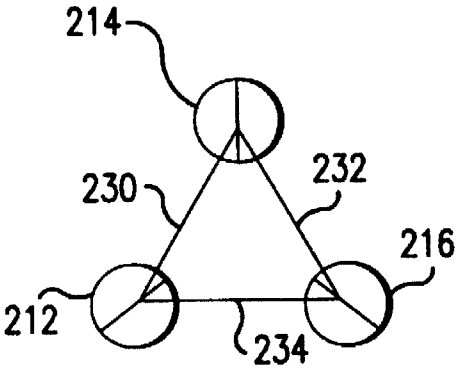
FIG. 2A schematically shows a single hopper feeding 3 oil shale calcining reactors according to the present invention.
Figure 2A:
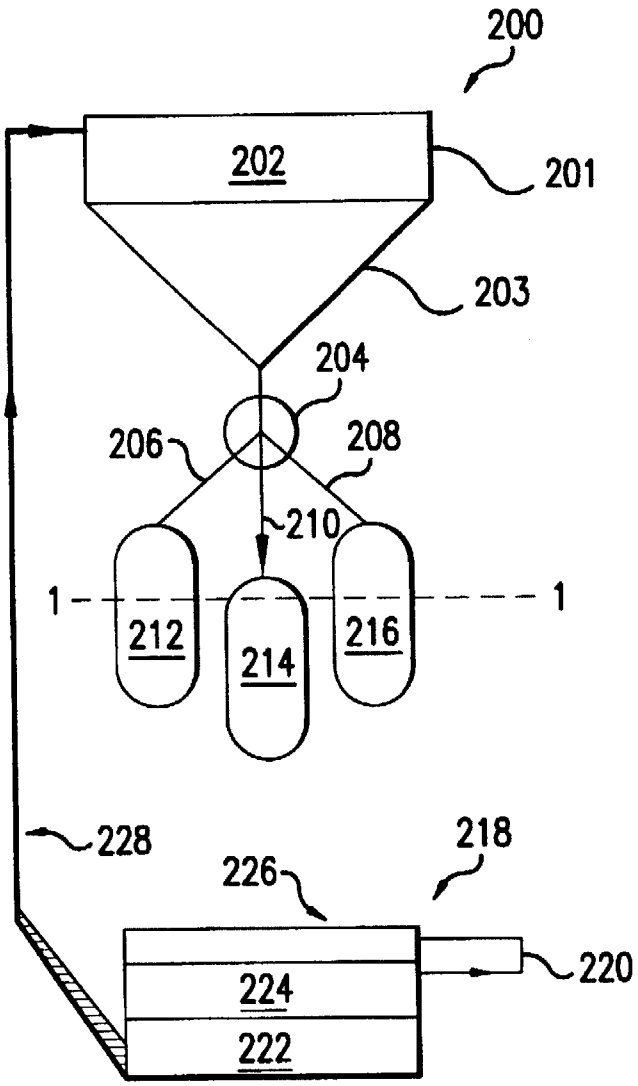

FIB. 2B shows a variation of FIG. 2A where a single chute is used to continuously feed oil shale.

FIG. 2C shows the placement of the 3 calcining oil shale reactors on an equilateral triangle according to the present invention.

Figure 3:
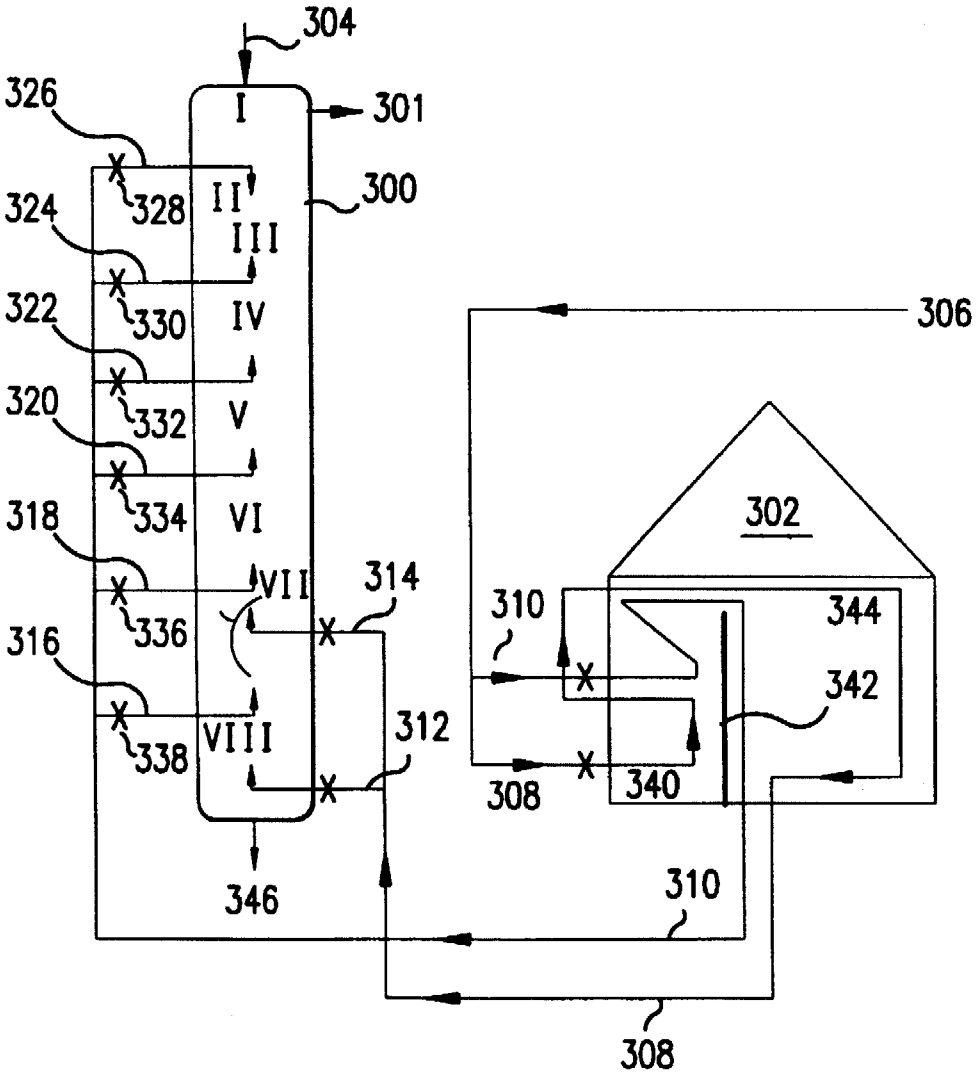

FIG. 3 shows a reactor that is fed with hydrogen that has been heated to two distinct temperatures for calcining oil shale according to the present invention.

Figure 4:
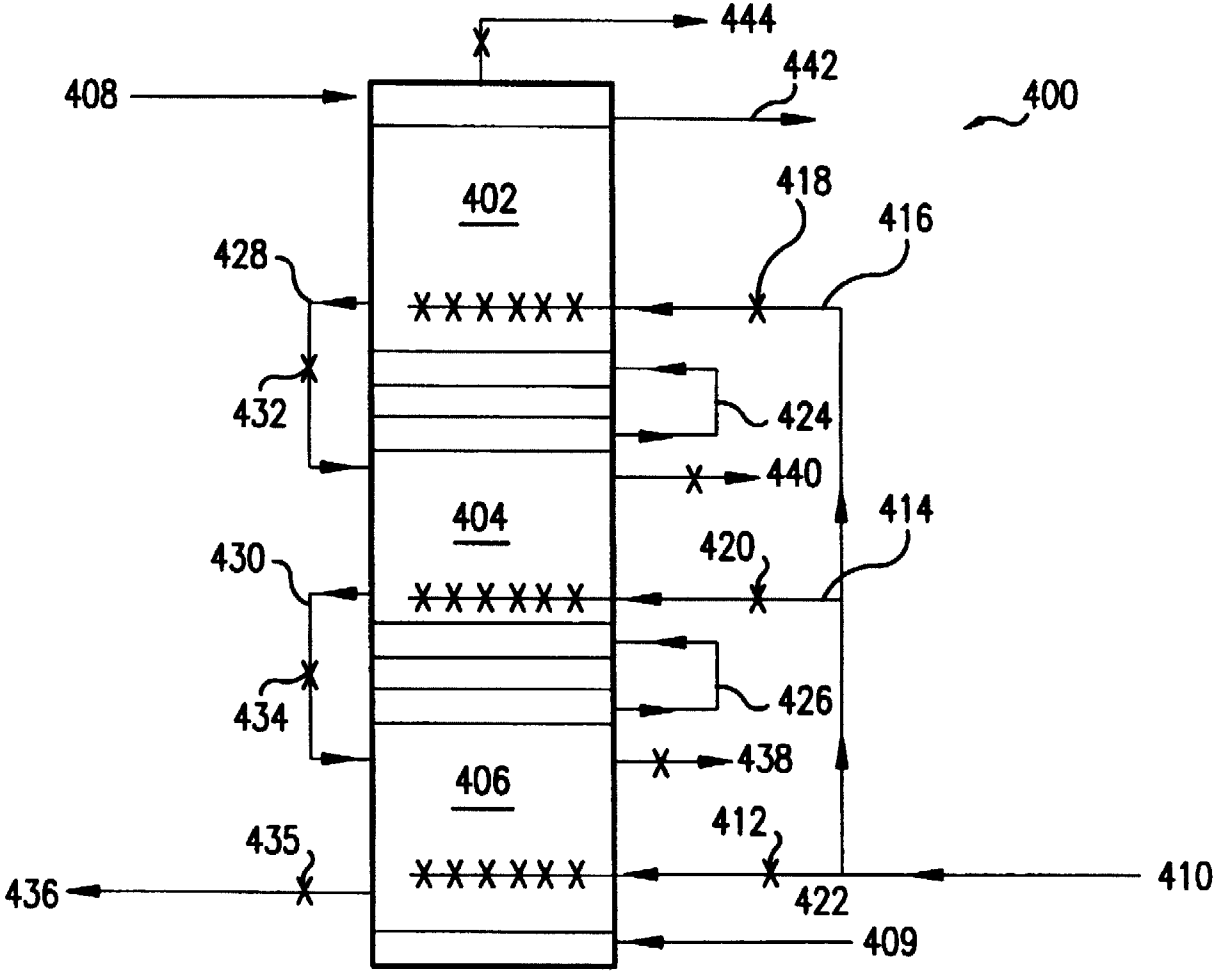

FIG. 4 shows a fluid bed heat exchanger for use in the present invention.

DETAILED DESCRIPTION OF THE INVENTION

The present invention relates to a process for continuously processing oil bearing material, such as oil shale or bitumen (tar sands), a system for its practice, and a process for land reclamation. According to the present invention, oil bearing material is continuously introduced and loaded into first, second and third reaction zones respectively during first, second and third sequential, predetermined time periods. The three reaction zones form the apexes of a triangle, preferably an equilateral triangle.

The first, second and third predetermined time periods are respectively defined as the first eight hours, the second eight hours and the third eight hours of a day, and run consecutively of one another. The introducing and loading steps are continuously repeated so that the first, second and third predetermined time periods run continuously and sequentially with one another. As a result, oil bearing material is (1) always being loaded; (2) always being calcined; and (3) always being discharged. Initially, oil shale or bitumen is loaded into a first reaction zone during the first predetermined time period, i.e., hours 1–8. During the initial start-up, the second and third reaction zones remain unused. However, when the system is in full operation, the second and third zones will respectively be in discharge and calcining modes during the first predetermined time period.

Immediately after loading the oil bearing material into the first reaction zone, a second predetermined period of time begins to run, i.e. hours 9–16. During this second predetermined period, the previously loaded oil bearing material in the first reaction zone is calcined. In the present invention, calcining, i.e., hydrocracking, involves both an endothermic cracking reaction and an exothermic hydrogenation reaction. During this initial (i.e., start-up) second predetermined time period, oil bearing material is concurrently loaded into the second reaction zone while the third reaction zone remains unused. When the system is in full operation, the third reaction zone will be in the discharge mode.

Immediately after the oil bearing material in the first reaction zone is calcined, a third sequential predetermined time period begins, i.e., hours 17–24. Spent oil bearing material and products produced in the first reaction zone are discharged during this third predetermined period of time. This discharging operation includes an initial depressurizing procedure followed by a fluidized discharge. During this same third predetermined time period, previously loaded oil bearing material in the second reaction zone is calcined and oil bearing material is loaded into the third reaction zone.

These three steps, loading, calcining and unloading, are continuously repeated so that the first reaction zone is reloaded with oil bearing material after material has been discharged therefrom during said repeated first predetermined time period. While the first reaction zone is being reloaded with oil bearing material, the second reaction zone is unloaded and the oil bearing material is calcined in the third reaction zone. The process continues whereby the second reaction zone is reloaded, the spent material and products in the third reaction zone are discharged and, the reloaded oil bearing material in the first reaction zone is calcined.

After initial startup, the continuous operating procedure involves (1) loading the reactors or reaction zones, (2) calcining the oil shale or bitumen, and (3) unloading the reactors of its contents. The contents that are unloaded include hydrogen and the spent shale or spent bitumen (tar sands).

The sequence of an exemplary daily cycle is as follows:

TABLE I

| Daily Hours | No. 1 Reactor | No. 2 Reactor | No. 3 Reactor | Daily Hours |
|---|---|---|---|---|
| 1st | Loading | Depressuring | Calcining | 1st |
| 2nd | Loading | Depressuring | Calcining | 2nd |
| 3rd | Loading | Unloading | Calcining | 3rd |
| 4th | Loading | Unloading | Calcining | 4th |
| 5th | Loading | Unloading | Calcining | 5th |
| 6th | Loading | Unloading | Calcining | 6th |
| 7th | Pressuring | Unloading | Calcining | 7th |
| 8th | Pressuring | Unloading | Calcining | 8th |
| 9th | Calcining | Loading | Depressuring | 9th |
| 10th | Calcining | Loading | Depressuring | 10th |
| 11th | Calcining | Loading | Unloading | 11th |
| 12th | Calcining | Loading | Unloading | 12th |
| 13th | Calcining | Loading | Unloading | 13th |
| 14th | Calcining | Loading | Unloading | 14th |
| 15th | Calcining | Pressuring | Unloading | 15th |
| 16th | Calcining | Pressuring | Unloading | 16th |
| 17th | Depressuring | Calcining | Loading | 17th |
| 18th | Depressuring | Calcining | Loading | 18th |
| 19th | Unloading | Calcining | Loading | 19th |
| 20th | Unloading | Calcining | Loading | 20th |
| 21st | Unloading | Calcining | Loading | 21st |
| 22nd | Unloading | Calcining | Loading | 22nd |
| 23rd | Unloading | Calcining | Pressuring | 23rd |
| 24th | Unloading | Calcining | Pressuring | 24th |

The invention will now be described with reference to FIGS. 2A–2C, 3 and 4.

Figure 2B:
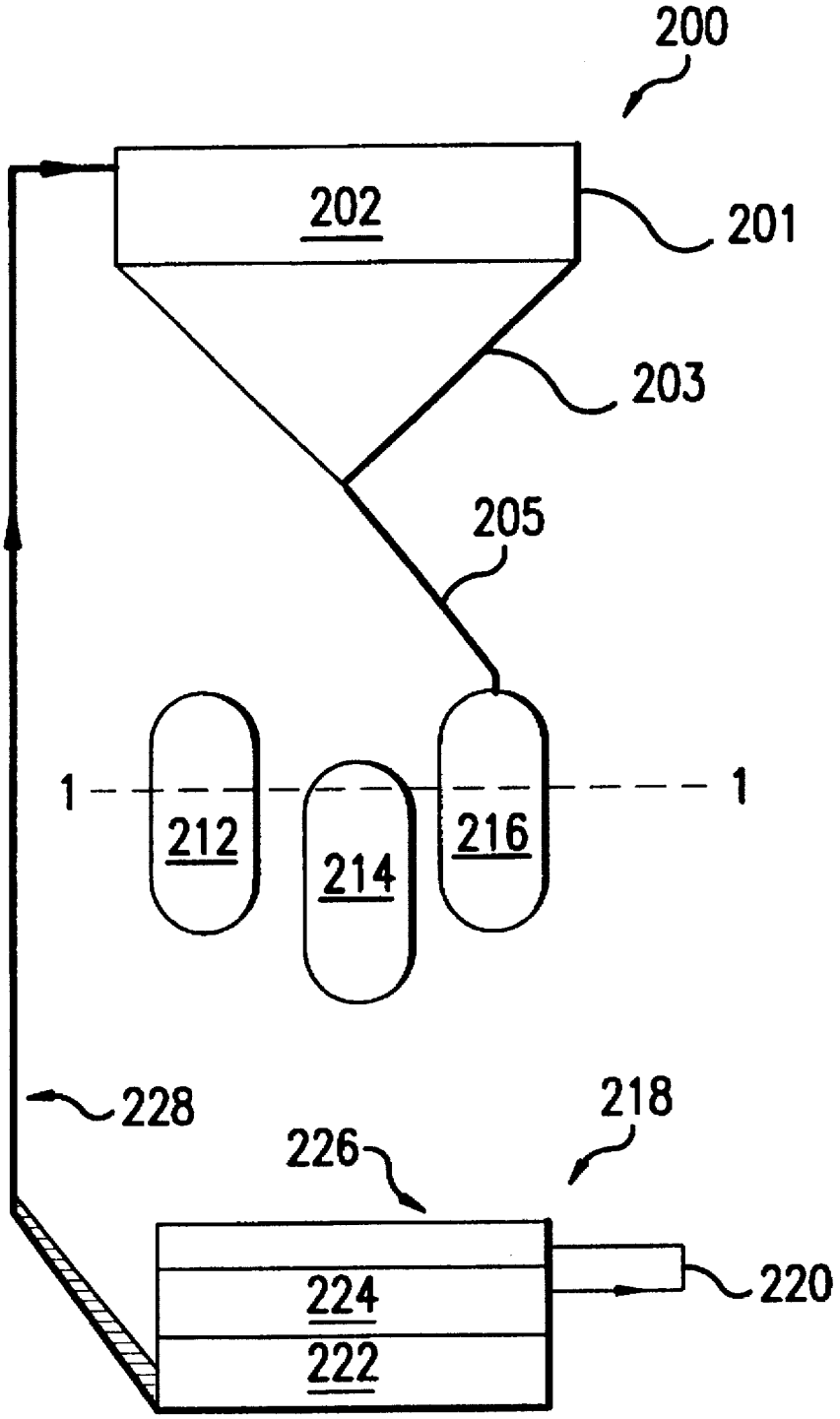

The shale loading system 200 is shown in FIGS. 2A and 2B, where oil shale from a mine is conveyed to shale preparation unit 218 containing a shale crusher 226, a 4 inch by 4 inch screen 224 and a small shale collection zone 222. Shale that is too large and does not pass through screen 224 is recycled through line 220 for recrushing in crusher 226. Collection zone 222 is located on the ground floor where crushed shale is conveyed to a bucket elevator 228. Shale is conveyed and loaded via bucket elevator 228 into hopper 201 located approximately 28 feet above the vertical, parallel reactor tubes 212, 214 and 216.

The capacity of the hopper 201 is sufficient to load the vertical reactor tubes 212, 214 and 216. The loading hopper 201 is 8 feet in diameter with a cylindrical shell portion 202 and a 60° conical bottom 203. The cylindrical shell 202 extends 15 feet above the top of the cone 203 that is 8 feet in diameter at its top. The cone 203 extends 8 feet below the cylindrical shell 202. FIG. 2A also shows that the bottom cone 203 is connected to a transfer conduit and flow valve 204 which regulates flow of the oil shale to lines 206, 208 and 210. Alternatively, the cone 203 can communicate directly with an 8 inch diameter "swing-tube" 205 (FIG. 2B) that is used to load the 2 foot diameter vertical reactor tubes 212, 214 and 216 that are 100 feet in height. In FIG. 2C, each reactor tube 212, 214 and 216 has a longitudinal axis that passes through an apex of an equilateral triangle.

The first predetermined time period lasts 8 hours and starts within the first hour at reactor 212. The second predetermined time period also lasts 8 hours when reactor 214 is loaded during the 9th to 16th hours and, then the third predetermined time period begins in the 17th hour when reactor 216 is loaded. Loading of reactors 212, 214 and 216 is a continuous operation day in and day out and includes about 6 hours of loading with shale and 2 hours of pressurizing with hydrogen.

Calcining of shale or tar sands begins in reactor 212 at the 9th hour, the onset of the second predetermined time period. It ends in reactor 212 at the end of the 16th hour, but continues during hours 17 to 24 in reactor 214, the third predetermined time period. Once the process is online, calcining will occur in reactor 216 during hours 1–8, the first predetermined time period. As a result, calcining is also a continuous process in reactors 212, 214 and 216, day in and day out.

The calcining reactor used in FIGS. 2A–2C is shown in greater detail in FIG. 3. In reactor 300, calcining, i.e, hydrocracking, involves cracking which is an endothermic reaction and hydrogenation, which is an exothermic reaction. Shale or tar sands at about 60° F., density of 50 lbs/ft$^3$ and 7500 tons/hr is loaded into reactor 300 through inlet 304. Spent shale powder at 900° F. is withdrawn through outlet 346 at 6750 tons/hr. The two hydrogen streams 308 and 310 respectively at temperatures of 820° F. and the other at 950° F. and, having a pressure of 600 psi, are used to control the temperatures in reactor 300. Cracking of the shale is preferably conducted at temperatures of about 800° F. to about 840° F.

Figure 1:
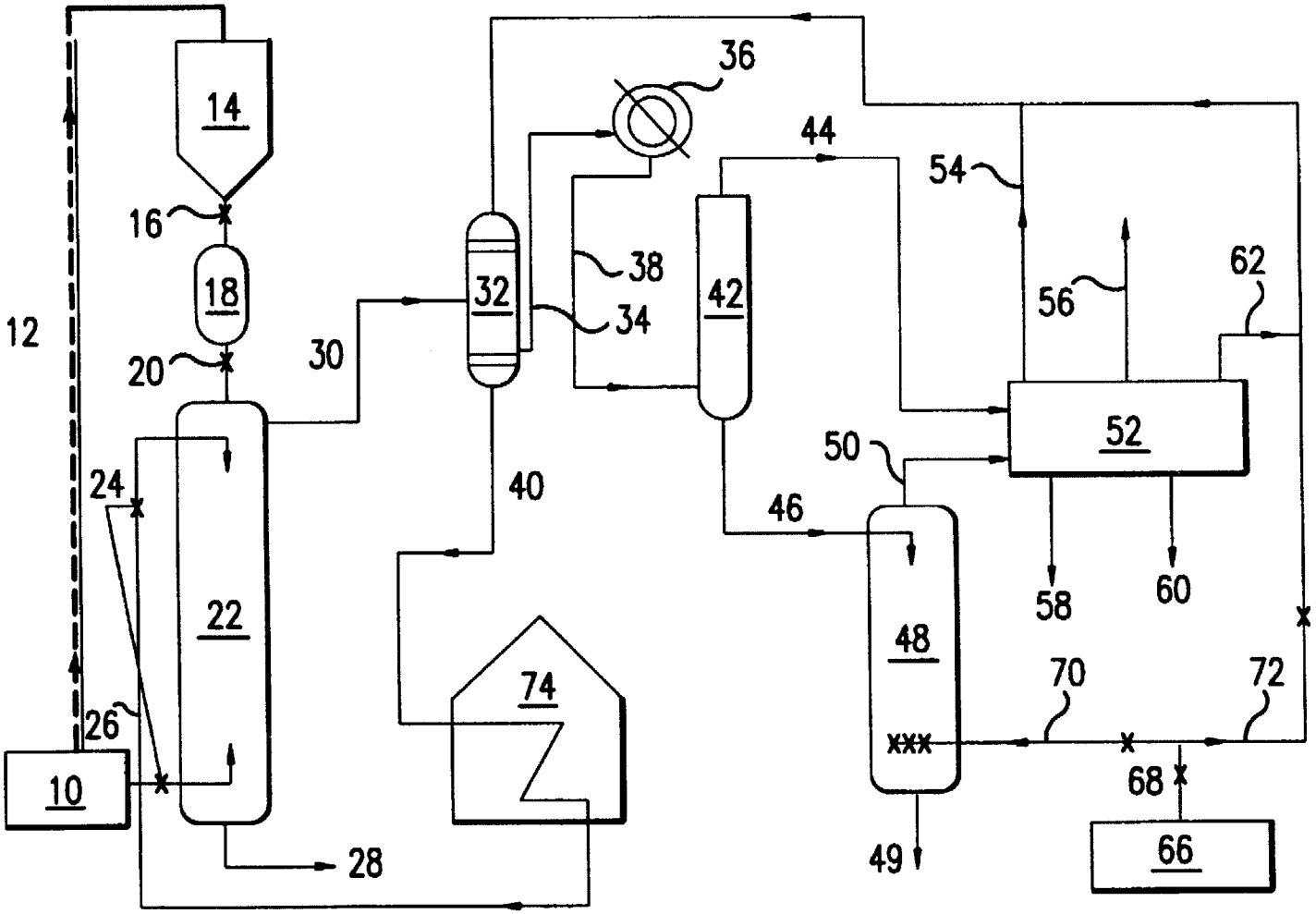
FIG. 1 shows a conventional process for processing oil shale with hydrogen in a fixed bed mode.

Hydrogen (fresh or recycled) is conveyed to reactor 300 through valved flow lines 308 and 310. Recycle hydrogen from a products recovery unit, such as unit 52 of FIG. 1, is conveyed through line 306 and split into two streams flowing through lines 308 and 310. Flow lines 308 and 310 extend into and pass hydrogen through furnace 302 having a convection section 340, a bridge wall and radiant section 344. Hydrogen in flow line 308 is heated in furnace 302 to 950° F. and is introduced into the bottom of reactor 300 through valved flow lines 312 and 314. Hydrogen in line 310 is heated in furnace 302 to about 820° F. and is introduced into reactor 300 through flow lines 316, 318, 320, 322, 324 and 326, respectively having flow valves 338, 336, 334, 332, 330 and 328. Products are removed from reactor 300 through outlet 301.

The following table provides, for illustrative purposes only, the temperature and residence time for the reactor of FIG. 3.

| REACTOR ZONE | APPROXIMATE TEMPERATURE (°F.) | RESIDENCE TIME (SEC./FT. OF REACTOR HEIGHT |
|---|---|---|
| I | | 1.3 to 1.42 |
| II | 780° | 1.42 to 1.65 |
| III | 800° | 1.65 to 1.88 |
| IV | 810° | 1.88 to 2.11 |
| V | 830° | 2.11 to 2.34 |
| VI | 820° | 2.34 to 2.57 |
| VII | 900° | 2.57 to 2.80 |
| VIII | 900° | 2.80 to 3.03 |

Calcining the oil shale or tar sands (bitumen-sands) is a very sensitive operation. It his highly important to maximize the yield of oil and if the temperature of calcining is too high a substantial part of the oil product will be cracked to gas. It is apparent that calcining oil shale and tar sands must be done at temperatures between 800° F. and 840° F., preferably nearer 800° F., in order not to further crack the large fragments of hydrogenated kerogen and bitumen. Gas yields must be held to a minimum so as to maximize transportation liquid fuels. Yields from a calcining operation that is conducted under excessive temperature conditions is shown in the analysis below.

TABLE 2

EXPERIMENTAL HYDROCRACKING OF NEW ALBANY SHALE FROM KENTUCKY

| Shale Composition | |
|---|---|
| Organic Matter - Wt - % | |
| Carbon | 13.4 |
| Hydrogen | 1.2 |
| Oxygen | 0.3 |
| Nitrogen | 0.4 |
| Sulfur (organic) | 1.0 |
| Mineral Carbonate Wt. - % $CO_2$ | 0.5 |

ANALYSES

| | ACTUAL | | CORRECTED | |
|---|---|---|---|---|
| Major Product: Target | Oil | Gas | Oil | Gas |
| Oil, gal/ton | 25 | 9 | 35.6 | 42.1 |
| Gas. SCF/ton (methane equivalent) | 1800 | 5100 | 10.0 | 10.0 |
| Carbon Recovery, % | 84 | 84 | 99.5 | 99.5 |

Data correction was obtained using the following factors:

379 cu. ft.=one lb mole–16 lbs of methane

Oil at 33.5° API=7.41 lbs/gal.

Maximum yield of gas=10 cu. ft./ton of shale. Hence, by allowing the temperature to get high, excessive cracking of oil product occurred.

Correcting the gas yield from 1,800 to 10 cu ft. resulted in the oil yield being increased from 25 to 35.6 gal/ton of shale. Recovering 99.5% vis-a-vis 84% of organic matter increased the oil yield further to 42.1 gal/ton.

Unloading

After the calcining operation is completed in a given reactor tube, that reactor tube must be unloaded. Spent shale or tar sands is discharged from reactors 212, 214 and 216, i.e., reactor 300, through outlet 346 and the contents are conveyed to a heat recovery system, e.g., heat exchanger, shown in FIG. 4. The three reactors, i.e., reactors 212, 214 and 216 are respectively unloaded after the 16th, 24th and 8th hours of a daily cycle.

Initially, each reactor containing 600 psi, 900° F. hydrogen is depressurized after each calcining step. The pressure in the given reactor is monitored in a manner well known to those skilled in the art and the 600 psi hydrogen is removed (i.e., depressurized) with hydrogen recycle pumps (compressors). When the monitored pressure in a given reactor is within 5 psi of zero gauge pressure, the reactor contents (spent shale or spent tar sands) are fluidized.

Fluidization of the spent shale or spent tar sands in the given reactor is provided by 850° F. flue gas from a compressor that is injected through jets distributed around the reactors so they can be used effectively to fluidize the spent contents into a fluidized bed. Automatic fluidization can occur by opening small valves that permit fluidizing flue gas to pass through the jets (not shown) in the lower portion of the reactor. The spent shale or tar sands is fluidized so that the reactor contents can be discharged as a freely flowing stream when the bottom of the reactor is opened.

Preferably a slight positive gauge pressure of 1 to 2 psi is maintained in the given reactor during fluidization with flue gas, to enhance the discharge of the spent contents to flow out rapidly, or even gush out. When the appropriate pressure in the depressurizing cycle is obtained, the bottom of each reactor is opened so the fluidized high temperature (900° F.) bed will flow freely out of the reactor to the fluid bed heat exchanger to transfer its sensitive heat to recycle hydrogen. The recycle hydrogen stream will be heated from 100° F. to 700° F. and the spent shale or sands will be cooled from 900° F. to 200° F.

To facilitate the continuous process, remote controlled motor driven valves or cocks (not shown) are used at the bottom of each of the reactors and upstream of the associated heat exchanger. The activation of each remote control valve or cock may be done manually or it may be automatically controlled by pressure near the bottom of each of the reactors.

The discharged spent oil bearing material is conveyed to a heat exchanger of the design shown in FIG. 4. The heat exchanger 400 contains sections 402, 404 and 406 maintained at 800° F., 500° F. and 200° F., respectively. Spent shale at 900° F. is introduced into heat exchanger 400 through line 408. Recycle hydrogen at 100° F. is injected through line 409. Flue gas is injected into heat exchanger 400 through flow lines 410 and spilt into individual streams 412, 414 and 416, having flow valves 422, 420 and 418. Spent shale is respectively transferred from sections 402, 404 and 406 via flow lines 428 and 430, each having slide valves 432 and 434. Spent shale at about 200° F. is removed through flow line 436 and slide valve 435. Heated recycle hydrogen at 700° F. is removed through flow line 442 and introduced into flow line 306. Hydrogen is conveyed from one section to the adjacent section through flow lines 424 and 426. Exhaust and flue gasses are withdrawn from sections 402, 404 and 406 respectively through flow lines 444, 440 and 438.

Existing oil shale processing systems, such as that of FIG. 1, can be retrofitted, as with the arrangement of FIGS. 2A and 2B. As a result, the intermittent operation of FIG. 1 for producing 180,000 bbls/day, is converted to a continuous operation.

For example, three seven foot diameter vertical reactors each 100 feet in height are used. The loading hopper for the retrofitted FIG. 1 system, would be similar to that shown in FIGS. 2A or 2B, except that shell 202 would be 20 feet in diameter and extend downward 35 feet to be welded to a 60° cone 203. The cone 203 would extend downwardly 20 feet. The apex of the cone bottom would connect to a 12 inch swing tube 205 of sufficient length to conveniently reach the inlet feed ports, i.e., 304, in the top of the reactors. The spacing of the 7 foot diameter vertical reactor tubes would be such that their center lines would pass through the apexes of a 10 ft×10 ft×10 ft equilateral triangle. Adjacent center lines would be ten feet apart, but 4 to 10 foot spacing is within the invention. The capacity of the loading hopper would be sufficient to load the three 7 foot diameter vertical reactor tubes. The sequence of Table 1 above is then followed to continuously produce oil.

Spent Oil Bearing Material Compositions

The spent oil bearing material produced in this or any oil shale process is used to improve the land from which the oil shale was mined/excavated. This has great environmental benefit. A major portion of the spent shale is mixed with waste organic material from nearby cities and created into top soil to eliminate the scars made on the terrain during the surface mining.

As a result, use of spent shale will, 1. provide the highest grade fertile topsoil for farm land;
2. provide a disposal site for certain garbage and waste paper from the cities by landfills; and
3. provide good use for the solids collected in the sewage disposal plants of the cities. Consequently, approximately 75–100% of the spent shale can be used for topsoil that will make excellent farmland.

The topsoil mixture prepared from spent oil bearing material and waste organic material can be augmented with synthetic fertilizer to give the precise nitrogen, potassium and phosphate balance needed. The hydrocracking process for oil recovery shown in FIG. 1 produces anhydrous ammonia which can provide the needed urea and ammonium nitrate fertilizer for nitrogen to balance the spent oil bearing material-organic waste soil replacement.

Cement Composition

Spent shale from the present invention is used as raw material to make Portland Cement which is a calcarious, argillaceous, siliceous mixture of minerals all of which are available in the spent shale. In this case, spent shale is discharged from the reactor 300 at 900°–920° F., through outlet 346 and is fed directly into a rotary kiln (not shown) where it is heated to 3000° F. until it is vitrified. The clinker is cooled, and pulverized into a greenish gray powder and used to make concrete and paving materials. The chemical composition of Portland Cement is $3CaO\ SiO_2 3CaOAl_2O_3$.

Although the invention has been described in conjunction with a specific embodiment, it is evident that many alternatives and variations will be apparent to those skilled in the art in light of the foregoing description and annex drawings. Accordingly, the invention is intended to embrace all of the alternatives and variations that fall within the spirit and scope of the appended claims.

I claim:

1. A continuous process for converting oil bearing material comprising, a. providing first, second and third discrete, reaction zones that are parallel to one another and disposed in a triangular configuration, b. introducing and loading oil bearing material sequentially into said first, second and third discrete reaction zones by sequentially feeding oil bearing material through an upper end of said first reaction zone during a first period of time; through an upper end of said second reaction zone during a second period of time; and through an upper end of said third reaction zone during a third period of time; and, continuously repeating said loading steps, whereby downward flow of said oil bearing material loads said first, second and third reaction zones for processing, and said first, second and third time periods run contiguously and sequentially of one another;

c. introducing first and second high pressure hydrogen streams, respectively at different temperatures, sequentially into each of said discrete reaction zones;

d. continuously and sequentially calcining said oil bearing material in the presence of said high pressure hydrogen introduced in step c in said respective discrete reaction zones to endothermically crack and exothermically hydrogenate components of the oil bearing material so that calcining is performed (1) in said first reaction zone during said second time period, (2) in said second reaction zone during said third time period and, (3) in said third reaction zone during said first time period; and e. sequentially unloading said high pressure, high temperature hydrogen and spent oil bearing material from said respective discrete reaction zones downwardly through a lower end of each reaction zone.

2. A process according to claim 1, wherein said discrete reaction zones are located on a respective apex of an equilateral triangle.

3. A process according to claim 2, wherein said equilateral triangle has sides that are between about 4 to about 10 feet in length.

4. The process according to claim 1, further including the steps of providing a fluidized bed heat exchanger, continuously introducing the discharged spent oil bearing material at about 900° F. from said discrete reaction zones into said fluidized bed heat exchanger, introducing hydrogen at a first temperature into said fluidized bed heat exchanger wherein heat from said spent oil bearing material is transferred to said hydrogen to raise the hydrogen temperature to a second temperature higher than said first temperature.

5. The process according to claim 4, further including the steps of splitting said hydrogen at said second temperature into first and second hydrogen flow streams and is introducing them into a furnace, heating said first hydrogen flow stream to a third temperature higher than said second temperature and heating said second hydrogen flow stream to a fourth temperature higher than said third temperature, said first and second hydrogen flow streams heated respectively to said third and fourth temperatures being used as said first and second high pressure hydrogen streams of step c.

6. A process according to claim 1, further comprising depressurizing said discrete reaction zones during said unloading step.

7. A process according to claim 5, wherein said depressuring steps are each immediately followed by a fluidizing step with flue gas at 850° F.

8. A process according to claim 5, wherein said fluidizing step includes introducing flue gas into each discrete reaction zone by circumferentially located gas introducing jets, whereby the spent oil bearing material is fluidized for downward unloading through said lower end of each discrete reaction zone.

9. A process according to claim 1, wherein said calcining is performed at temperatures between about 800° F. and 840° F.

10. A process according to claim 5, wherein said third and fourth temperatures are respectively about 800° F. and 950° F.

11. A process according to claim 4, wherein said first high pressure hydrogen stream is introduced into each reaction zone at a plurality of locations along the length of each reaction zone which is defined by a vertical reactor tube.

12. A process according to claim 11, where said second high pressure hydrogen stream is introduced into each vertical reactor tube at at least one location adjacent said lower end of the vertical reactor.

13. The process according to claim 1, wherein said introducing and loading step include a reaction zone pressurizing step.

* * * * *